US005771818A

United States Patent [19]

Tada et al.

[11] Patent Number: 5,771,818

[45] Date of Patent: Jun. 30, 1998

[54] COOLING SYSTEM FOR WASTE DISPOSAL DEVICE

[75] Inventors: Shuji Tada, Higashimatsuyama; Jun Aoki, Misato, both of Japan

[73] Assignee: Prometron Technics Co., Ltd., Tokyo, Japan

[21] Appl. No.: 650,297

[22] Filed: May 20, 1996

[51] Int. Cl.[6] ..... F23G 5/00

[52] U.S. Cl. ..... 110/250; 219/121.49

[58] Field of Search ..... 110/250; 219/121.48, 219/121.49

[56] References Cited

U.S. PATENT DOCUMENTS

| | | | |
|---|---|---|---|
| 4,242,562 | 12/1980 | Karinsky et al. . | |
| 4,644,877 | 2/1987 | Barton et al. | 110/250 |
| 4,645,899 | 2/1987 | Bebber et al. | 219/121.49 |
| 4,650,953 | 3/1987 | Eger et al. . | |
| 5,353,719 | 10/1994 | Eshleman et al. . | |
| 5,363,781 | 11/1994 | Chang et al. | 110/250 |
| 5,393,952 | 2/1995 | Yamaguchi et al. | 219/121.48 |
| 5,501,159 | 3/1996 | Stevers et al. . | |

FOREIGN PATENT DOCUMENTS

| | | |
|---|---|---|
| 58-800 | 1/1983 | Japan . |
| 63-315819 | 12/1988 | Japan . |
| 64-10016 | 1/1989 | Japan . |
| 4126146 | 4/1992 | Japan . |

OTHER PUBLICATIONS

Industrial Prospectus, Jan., 1995—Electric Power Research Institute, Inc. (EPRI) Industrial Prospectus, Sep. 1994, EPRI.

"Emerging Medical Waste Treatment Technologies: an EPRI Status Sheet", May, 1993—EPRI.

*Primary Examiner*—Henry A. Bennett
*Assistant Examiner*—Susanne C. Tinker
*Attorney, Agent, or Firm*—Wood, Phillips, VanSanten, Clark & Mortimer

[57] ABSTRACT

A waste disposal device having a wall structure defining an incineration space, a torch assembly separate from the wall structure, and first structure cooperating between the torch assembly and wall structure for maintaining the torch assembly in an operative position on the wall structure. The torch assembly has a torch for generating heat in the incineration space with the torch assembly in the operative position. The torch assembly further has second structure for circulating a cooling liquid in heat exchange relationship with the torch assembly, independently of the wall structure, to thereby effect cooling of the torch assembly. In one form, the torch assembly is removably maintained in the operative position on the wall structure.

21 Claims, 7 Drawing Sheets

COOLING SYSTEM FOR WASTE DISPOSAL DEVICE

BACKGROUND OF THE INVENTION

1. Field of the Invention

This invention relates to waste disposal devices of the type using one or more torches to incinerate waste product and, more particularly, to a cooling system to dissipate detrimental heat generated by the torches in operation.

2. Background Art

Disposal of waste worldwide remains a vexatious problem. Various different methods have been devised in the past to effect this disposal in a manner to address both health and environmental concerns. For example, it is known to dispose of medical waste of the type contaminated with human blood and waste, radioactive materials, and environmentally harmful substances commonly found in routine metropolitan waste, by sealing these products in concrete and either sinking the concrete shell containing the waste products to the bottom of the ocean or using them as a base in land reclamation.

This system of disposal has a number of inherent problems. First of all, it is difficult to find a suitable site for disposal in water or on undeveloped land. Further, the ultimate decomposition of the concrete and its contents may result in the release of contaminants to water supplies and/or solid ground.

These and other problems lead to the advent of waste disposal through reconstitution of the waste using a high temperature plasma discharge. In this type of system, a torch is used to create a plasma arc within an incineration space. The high temperature produced by the plasma torch efficiently burns and melts the waste. However, the plasma torch not only creates a high temperature environment in the incinerator, but also conducts heat to the electrode region of the plasma torch, detrimentally elevating the temperature of the torch and the region of the incinerator in proximity thereto.

The inventors herein attempted to control temperature elevation by providing an annular flow passageway around the torch on the interior of the incinerator. Cooling water was input from the exterior of the incinerator through the annular passageway to thereby dissipate heat on the interior surface of the incinerator wall. The passageway was sealed by welds made on the inside of the incinerator wall so that the welds were directly exposed to the high temperature environment in the incineration space. As a result, the welds deteriorated and cracked. Once cracks begin to generate in this type of system, leakage may occur, as a consequence of which overheating and equipment failure are inevitable.

Further, since the failed welds were on the interior of the wall structure, inspection and maintenance of the cooling systems had to take place inside of the wall structure. For regular maintenance, the technician would have to wait for a lengthy period of time for the incinerator walls to cool down to a safe temperature or effect the repairs with the incinerator space and walls at a dangerously high temperature. By proceeding in the former manner, a significant down time may result. By proceeding in the latter manner, the technician is both uncomfortable and prone to injury.

SUMMARY OF THE INVENTION

The present invention has as one of its objectives to overcome one or more of the above problems.

In one form of the invention, a waste disposal device is provided having a wall structure defining an incineration space, a torch assembly separate from the wall structure, and first structure cooperating between the torch assembly and wall structure for maintaining the torch assembly in an operative position on the wall structure. The torch assembly has a torch for generating heat in the incineration space with the torch assembly in the operative position. The torch assembly further has second structure for circulating a cooling liquid in heat exchange relationship with the torch assembly, independently of the wall structure, to thereby effect cooling of the torch assembly. In one form, the torch assembly is removably maintained in the operative position on the wall structure.

By reason of the cooling liquid being circulated in the removable torch assembly, maintenance to the torch assembly can be effected by separating the torch assembly from the wall structure. Inspection and maintenance of the torch assembly can thus be carried out safely and efficiently.

Another objective of the invention is to circulate the cooling liquid in heat exchange relationship with the torch assembly so that adequate cooling thereof takes place. In one form, the torch assembly has a base plate and a torch holder on the base plate. The torch holder defines a seat for one or more of the torches. Cooling liquid can be circulated in heat exchange relationship with the base plate and/or the torch holder.

A passage is defined for the cooling liquid by a plurality of metal parts which can be welded together. In one form, independent systems are provided for circulating cooling liquid in the torch holder and the base plate.

In one form the passage for cooling liquid in the base plate is defined by spaced flat parts. In one form, the cooling fluid can be circulated fully around the torch holder within the base plate passage.

The torch holder may include a cylindrical element against which the torch is seated. In one form, the passage is defined in the cylindrical element to guide circulation of cooling liquid in heat exchange relationship with the cylindrical element.

Another objective of the present invention is to facilitate assembly and disassembly of the torch assembly. The torches may be removable from the torch holder, which is removable from the base plate. The base plate may in turn be attachable directly to the wall structure to seal a mounting opening for the torch assembly provided in the wall structure. Regular scheduled maintenance and repairs are thus facilitated.

Similar torch assemblies can be provided at different locations on the wall structure, as required.

Another objective of the present invention is to construct the torch assembly so that the torch assembly is resistant to deterioration by reason of exposure to the high temperature environment in the incineration space. In one form, the various frame parts defining the liquid flow passages are configured to allow welding at locations that are not exposed directly to the incineration space.

While the invention described herein is particularly useful in an environment wherein a plasma torch is utilized, the invention is useable in the same manner with other types of torches and heat sources.

DETAILED DESCRIPTION OF THE DRAWINGS

Figure 1:
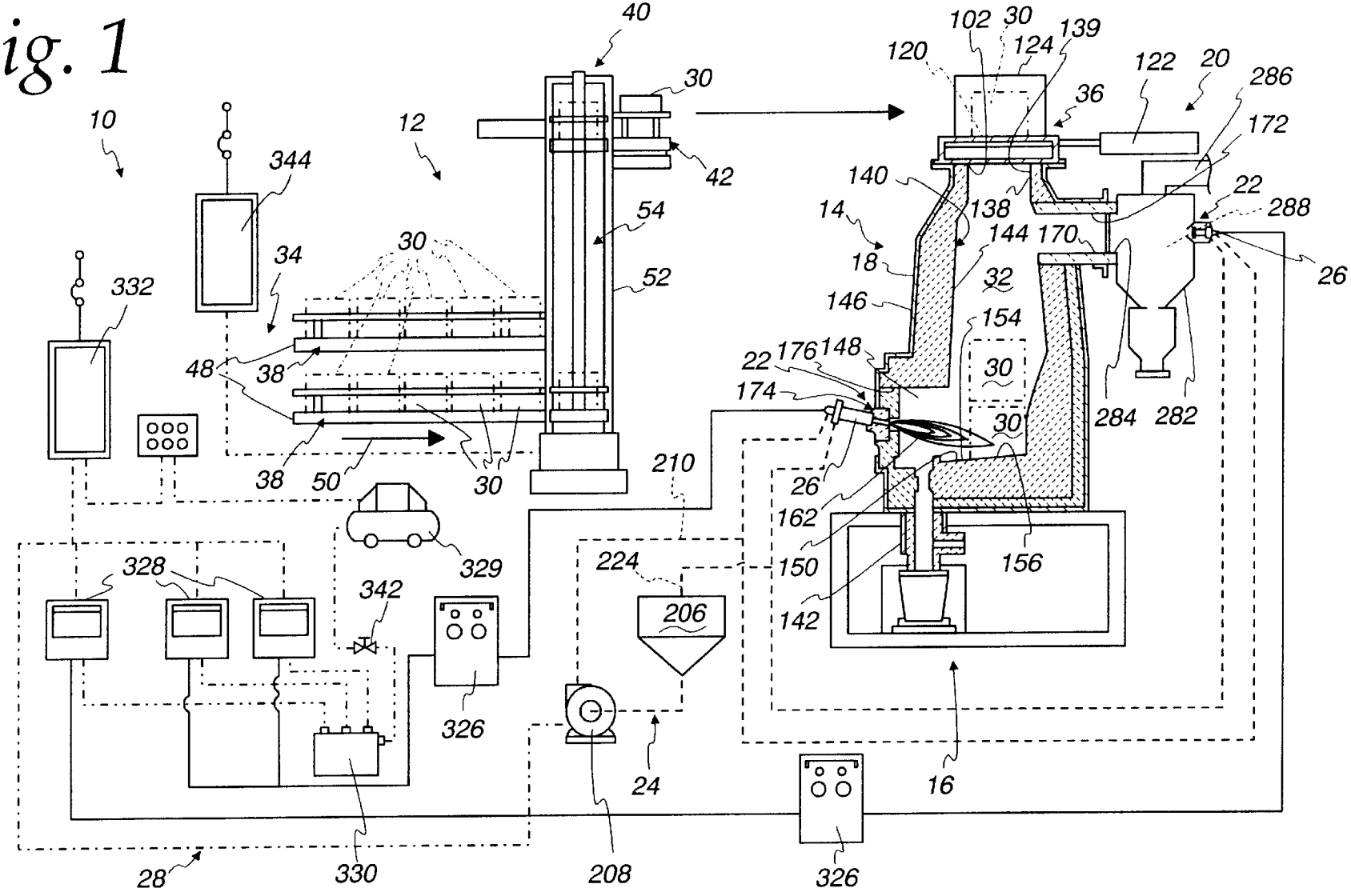
FIG. 1 is a front, schematic representation of a waste disposal system incorporating a waste disposal device, according to the present invention.
Figure 2:
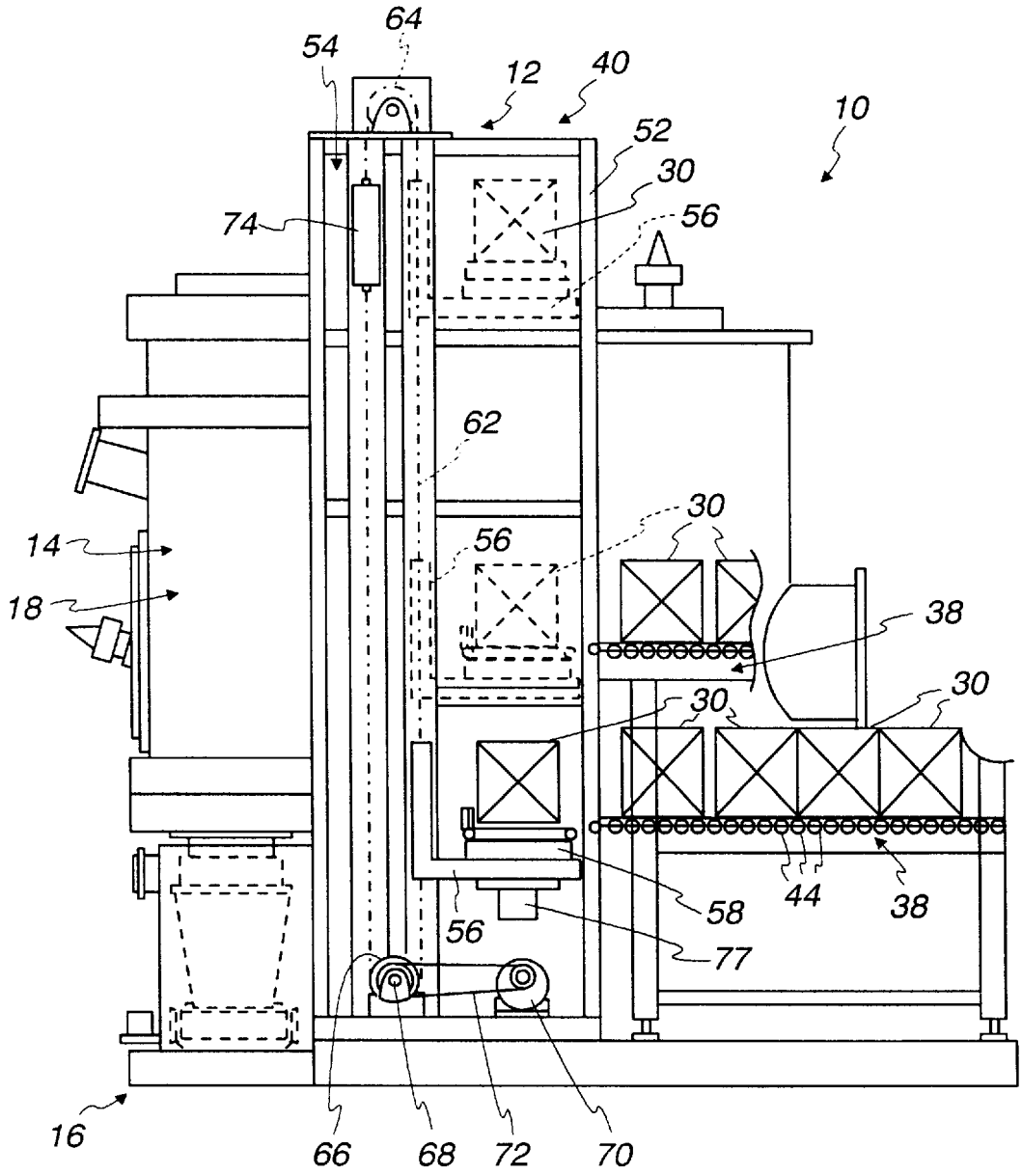
FIG. 2 is a schematic, side elevation view of the waste disposal system of FIG. 1.
Figure 3:
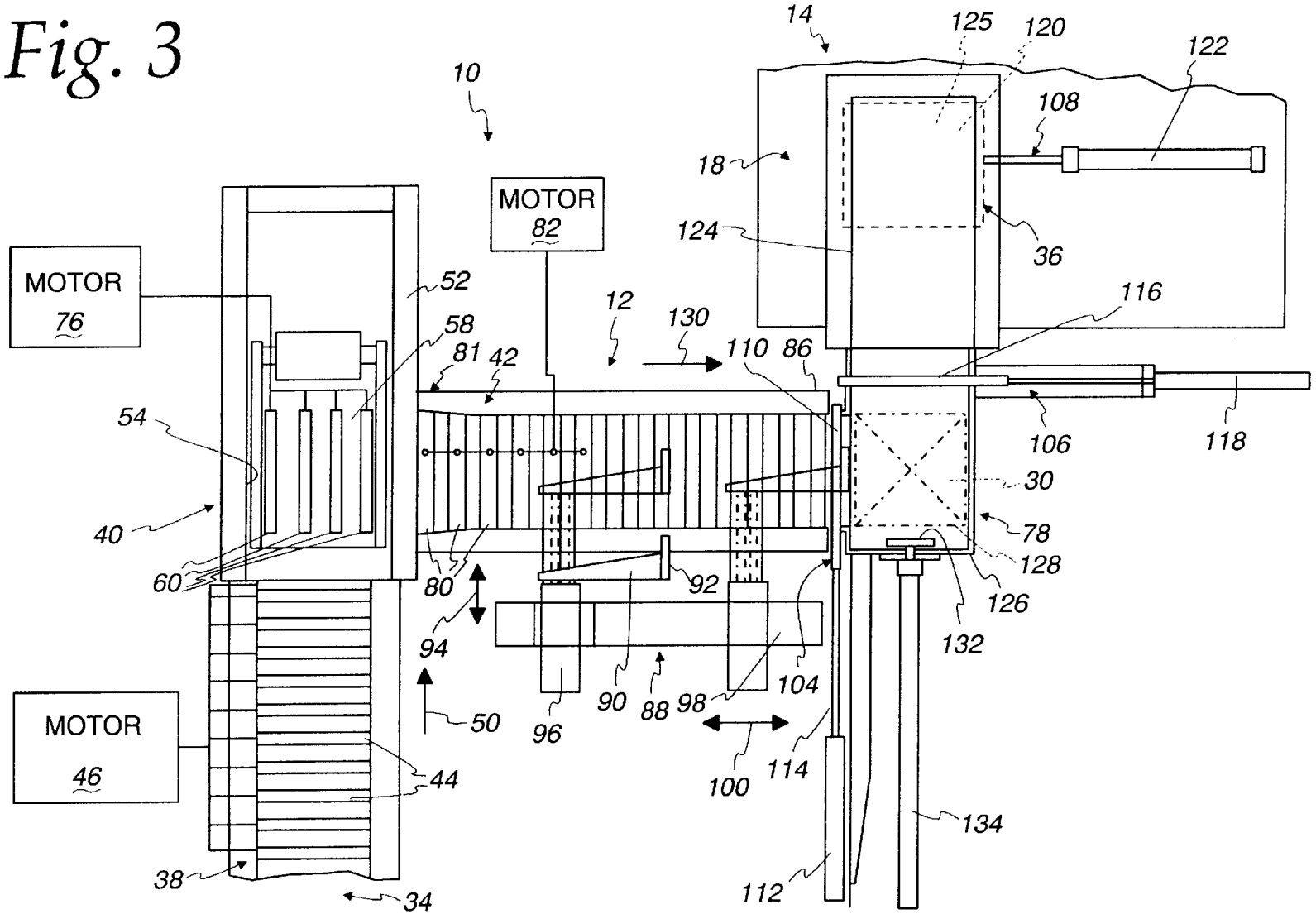
FIG. 3 is a schematic, fragmentary, plan view of the waste disposal system in FIGS. 1 and 2.
Figure 4:
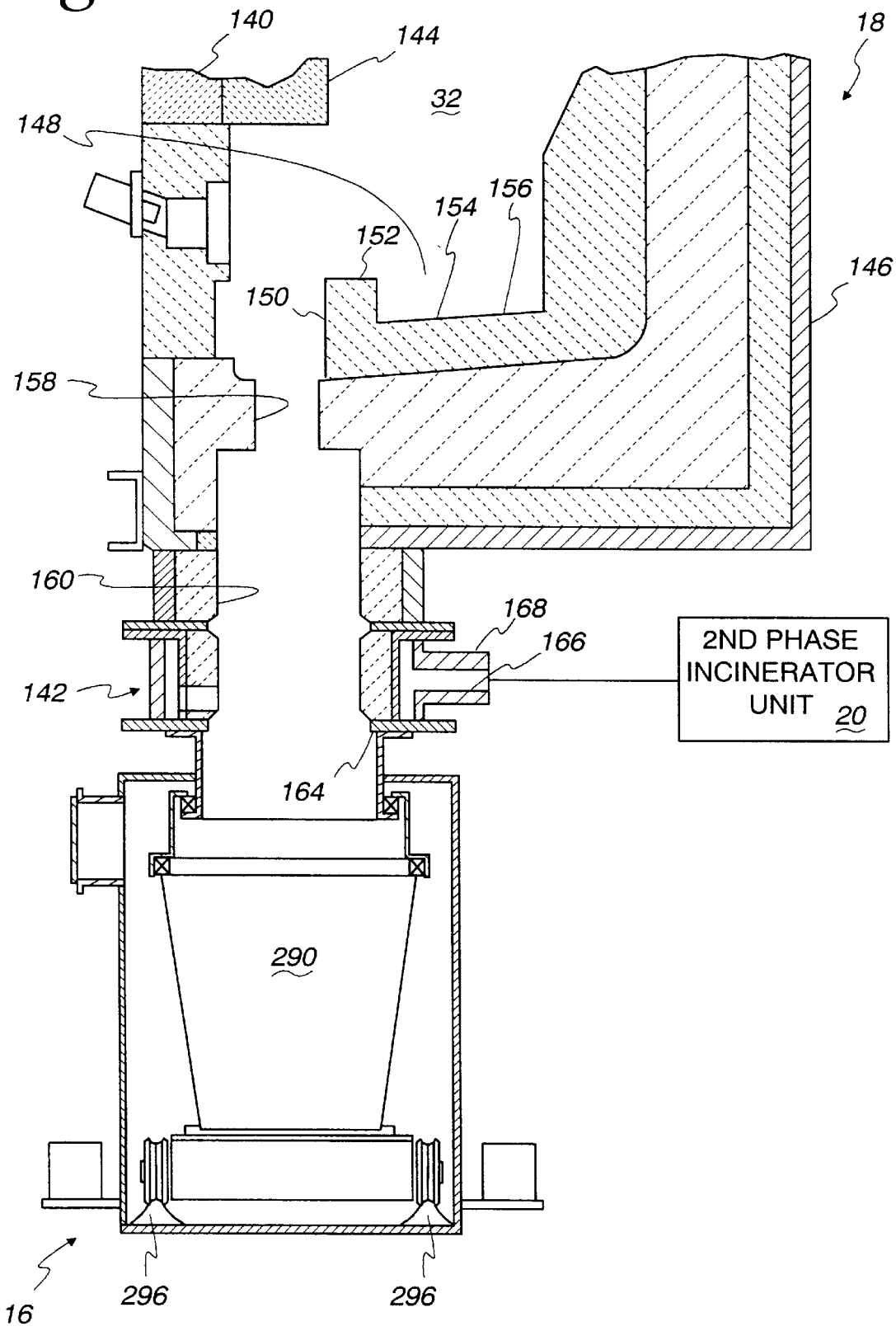
FIG. 4 is an enlarged, fragmentary, cross-sectional view of an incineration space and discharge nozzle on the waste disposal device in FIGS. 1–3.

Referring initially to FIGS. 1–3, a waste disposal system, suitable for incorporation of the present invention, is shown at 10. The waste disposal system 10 is made up of several cooperating subsystems, which will be separately described below. A waste feed subsystem at 12 delivers waste product to an incineration subsystem 14 in which the waste is reconstituted to slag, which is discharged in a molten state into a slag collection subsystem 16. The incineration subsystem 14 includes a waste disposal device 18 which performs as a primary, first phase incineration unit, and a second phase incineration unit at 20.

The present invention focuses principally upon a torch assembly 22, as part of the waste disposal device 18, which torch assembly 22 includes a cooling subsystem at 24. The operation of torches 26 on the torch assembly 22 is effected through a control subsystem at 28.

Briefly, the waste feed subsystem 12 delivers individual containers 30 with waste product therein to the top of the waste disposal device 18, from where the containers 30 are introduced to an incineration space/pyrolysis chamber 32. In the incineration space 32 the waste is reconstituted to slag that is discharged to the slag collection subsystem 16 and from there appropriately disposed of. Gas byproducts from the reconstitution are drawn off and treated in the second phase incineration unit 20. The control subsystem 28 coordinates the torch operation with the operation of the second phase incineration unit 20. During operation of the torches 26, a cooling liquid, preferably water, is circulated in heat exchange relationship with the torch assembly 22 through the cooling subsystem 24. Individual subsystems in the waste disposal system 10 will now be described separately in detail. It should be understood that the waste disposal device 18, while described in relationship to a specific arrangement of cooperating components, could be used according to the present invention in other environments.

Waste Feed Subsystem 12

The waste feed subsystem 12 is designed to serially convey waste filled containers 30 from an input location 34 to a delivery location at 36 atop the waste disposal device 18. The subsystem 12 is designed to convey containers 30 having a generally squared configuration. For safety and ecological reasons, the containers 30 are preferably made from a polyethylene based material, which type of container is readily commercially available. Incineration of this type of container 30 does not produce any significant harmful or toxic gas product.

The waste feed subsystem 12 has a pair of vertically spaced, input conveyors 38, an elevator section 40, and an output conveyor 42. A plurality of cylindrical, carrying rollers 44 on each conveyor 38 is driven by a motor 46 to thereby advance containers 30 from the input end 48 of each conveyor 38 in the direction of the arrow 50 to the elevator section 40.

The elevator section 40 has a frame 52 bounding a vertical conveying space 54 for the containers 30. The frame 52 guides an L-shaped lift platform 56 within the space 54 between a pickup position, shown in solid lines in FIG. 2 for the lower conveyor 38, and a discharge position, at the top of the space 54. The lift platform 56 carries a support plate 58, which in turn mounts a plurality of cylindrical conveying rollers 60 upon which the containers 30 can be supported.

An endless chain 62 is trained around vertically spaced sprockets 64, 66. The lower sprocket 66 is fixed to a shaft 68 which is driven by a motor 70 through a separate chain or belt 72. The motor 70 is operated to drive the chain 62 selectively in opposite directions to thereby raise and lower the lift platform 56, which is attached to the chain 62. A counterbalancing weight 74 is attached to the chain 62 to reduce the torque that must be generated by the motor 70 to advance the chain 62 to effect movement of the lift platform 56.

The conveying rollers 60 are driven by a motor 76 to effect transfer of the containers 30 from the input conveyor 38 to the output conveyor 42. The support plate 58 is pivotably attached to the lift platform 56 for rotation about a vertically extending axis. Rotational movement of the plate 58 can be imparted through a motor 77, whereby the orientation of the roller 60 can be changed to facilitate receipt and discharge of containers 30.

The output conveyor 42 directs containers 30 from the elevator section 40 to a transition location 78 at the height of the delivery location 36 i.e. at the top of the waste disposal device 18. The conveyor 42 has cylindrical carrying rollers 80, which rollers 80 on the upstream end 81 are driven by a motor 82. The rollers 80 on the downstream end 86 of the conveyor 42 are freely rotatable.

The conveyor 42 has an associated pusher system at 88. The pusher system 88 includes a cantilevered pusher arm 90 with a plate 92 thereon to engage the trailing end of the advancing containers 30 at the midportion of the conveyor 42. The pusher arm 90 is selectively extended and retracted transversely to the length of the conveyor 42, in the line of the double-headed arrow 94, by an air cylinder 96. A second air cylinder 98 is extended and retracted to move the air cylinder 96 and the arm 90 thereon in the line of the double-headed arrow 100, parallel to the length of the conveyor 42.

To advance a container 30 along the conveyor 42 with the pusher system 88, the cylinders 96, 98 are operated to move the arm 90 and plate 92 thereon downwardly and to the left in FIG. 3. By operating the cylinder 96, the pusher plate 92 is moved adjacent to the trailing end of a container 30 on the conveyor 42. By then operating the cylinder 98, the pusher plate 92 moves from left to right, thereby advancing the container 30 to the transition location at 78.

It should be understood that while rollers are shown on each of the conveyors 38, 42 and on the lift platform 56, these rollers could be replaced by any other known advancing mechanism, such as a chain or a rubber belt.

The containers 30 are maneuvered from the transition location 78 to the delivery location 36 and to and through an upper entry opening 102 on the waste disposal device 18 to the incineration space 32 by a series of cooperating damper systems 104, 106, 108.

The damper system 104 has a vertically extending blocking plate 110 that is movable by a cylinder 112 between a blocking position, shown in solid lines in FIG. 3, and a retracted position, out of the path between the conveyor 42 and the transition location 78. Extension and retraction of a rod 114 on the cylinder 112 effects this repositioning of the blocking plate 110.

The damper system 106 has a vertically extending blocking plate 116 which is placed selectively in a blocking position, as shown in solid lines in FIG. 3, and a retracted position, by operation of a cylinder 118.

The damper system 108 has a horizontally disposed blocking plate 120 which is repositioned through a cylinder 122 between a blocking position, wherein the blocking plate 120 seals over the entry opening 102, and a retracted position, wherein the entry opening 102 is exposed to allow delivery therethrough of a container 30 to the incineration space 32.

A shroud 124 is mounted over the entry opening 102 and defines a chamber 125 through which the containers 30 are passed as they are communicated to the entry opening 102. An additional shroud 126 defines a chamber 128 for the containers 30 at the transition location 78.

In operation, with the blocking plate 110 retracted, the containers 30 conveying in the direction of the arrow 130 on the conveyor 42 are discharged to the chamber 128. By retracting the next blocking plate 116, extension of a ram 132 upwardly in FIG. 3, through a pneumatic or hydraulic cylinder 134, causes the container 30 to be driven into the chamber 125 immediately over the entry opening 102. By retracting the blocking plate 120 through the cylinder 122, the containers 30 move under their own weight through the entry opening 102, and a neck 138 defining a passage 139 and the entry opening 102, to the incineration space 32. The entry opening 102 and neck passage 139 preferably have a cylindrical diameter which is large enough to allow the containers 30 to pass, without any appreciable resistance, to the incineration space 32.

Incineration Subsystem 14

The waste disposal device 18, as seen in FIGS. 1 and 4–9, has a wall structure 140 that bounds the incineration space 32 and defines a discharge nozzle 142 for communicating molten slag from the incineration space 32 to the slag collection subsystem 16. The internal surface 144 of the wall structure 140 bounding the incineration space 32 is defined by a fire resistant material. Suitable materials are an acid resistant material, such as $SiO_2$ or $TiO_2$, or chlorine base resistant MgO or CaO. The outer shell 146 on the wall structure 140 is preferably made from a non-magnetic material, such as stainless steel.

The high temperature melting/pyrolysis region 148 of the incineration space 32 is bounded by a stepped position 150 of the wall structure 140. An upwardly projecting ledge 152 on the stepped position 150 bounds a reservoir 154. Incoming containers 30 are funnelled through the incineration space 32 into the reservoir 154 to against an upwardly facing surface 156 bounding the reservoir 154. The surface 156 is inclined downwardly toward the ledge 152 and an adjacent outlet opening 158 in communication with a discharge passage 160 defined by the discharge nozzle 142. The containers 30 stacked in the reservoir 154 are strategically located to be impinged upon by the heat from the torches 26.

In a preferred form, the torches 26 are plasma torches which generate a plasma arc 162 that causes melting of the containers 30 and the contents thereof. When sufficient masses of the material are reconstituted to slag in the reservoir 154, the slag depth exceeds the height of the ledge 152 so that the slag flows over the ledge 152, through the outlet opening 158 and the discharge passage 160 on the nozzle 142, and to the outlet end 164 of the nozzle 142. The discharge of slag from the reservoir 154 to the outlet opening 158 is further facilitated by the development of suction in a passageway 166 defined by a fitting 168, which passageway 166 is in communication with the discharge passage 160 on the discharge nozzle 142. The suction developed in the fitting passageway 166 draws exhaust gas from the high temperature melting region 148, from where it is communicated to the second phase incineration unit 20.

Exhaust gas at the upper region of the incineration space 32 is drawn off through a conduit 170. The exposed annular surface 172 of the conduit 170 is made preferably from the same fire resistant material as is the internal surface 144 bounding the incineration space 32.

Figure 6:
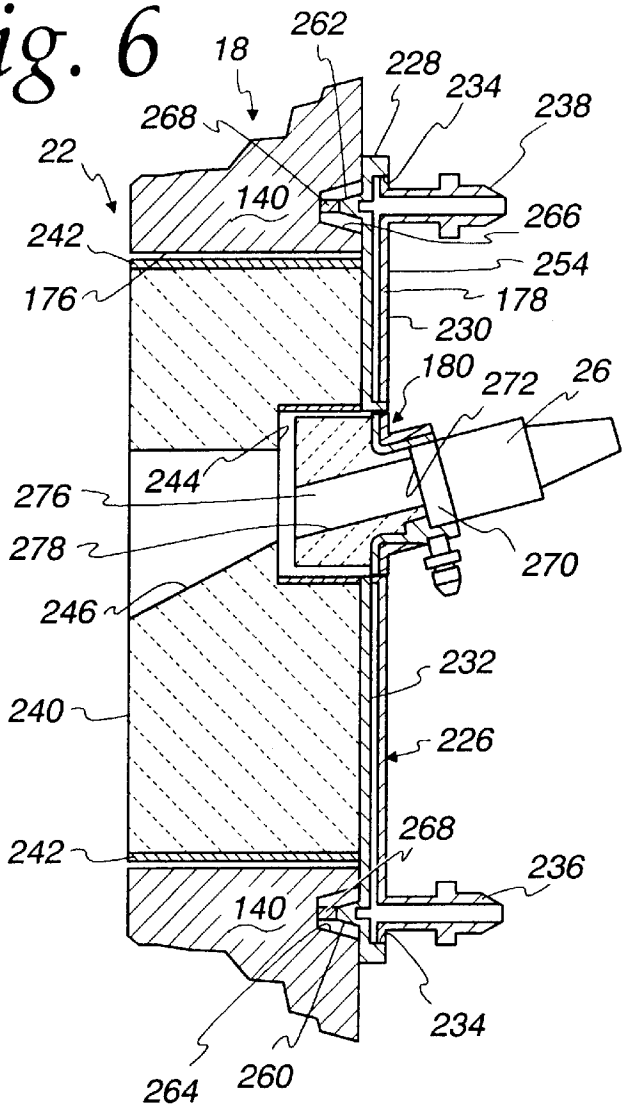
FIG. 6 is a cross-sectional view of the torch assembly taken along line 6—6 of FIG. 5.
Figure 5:
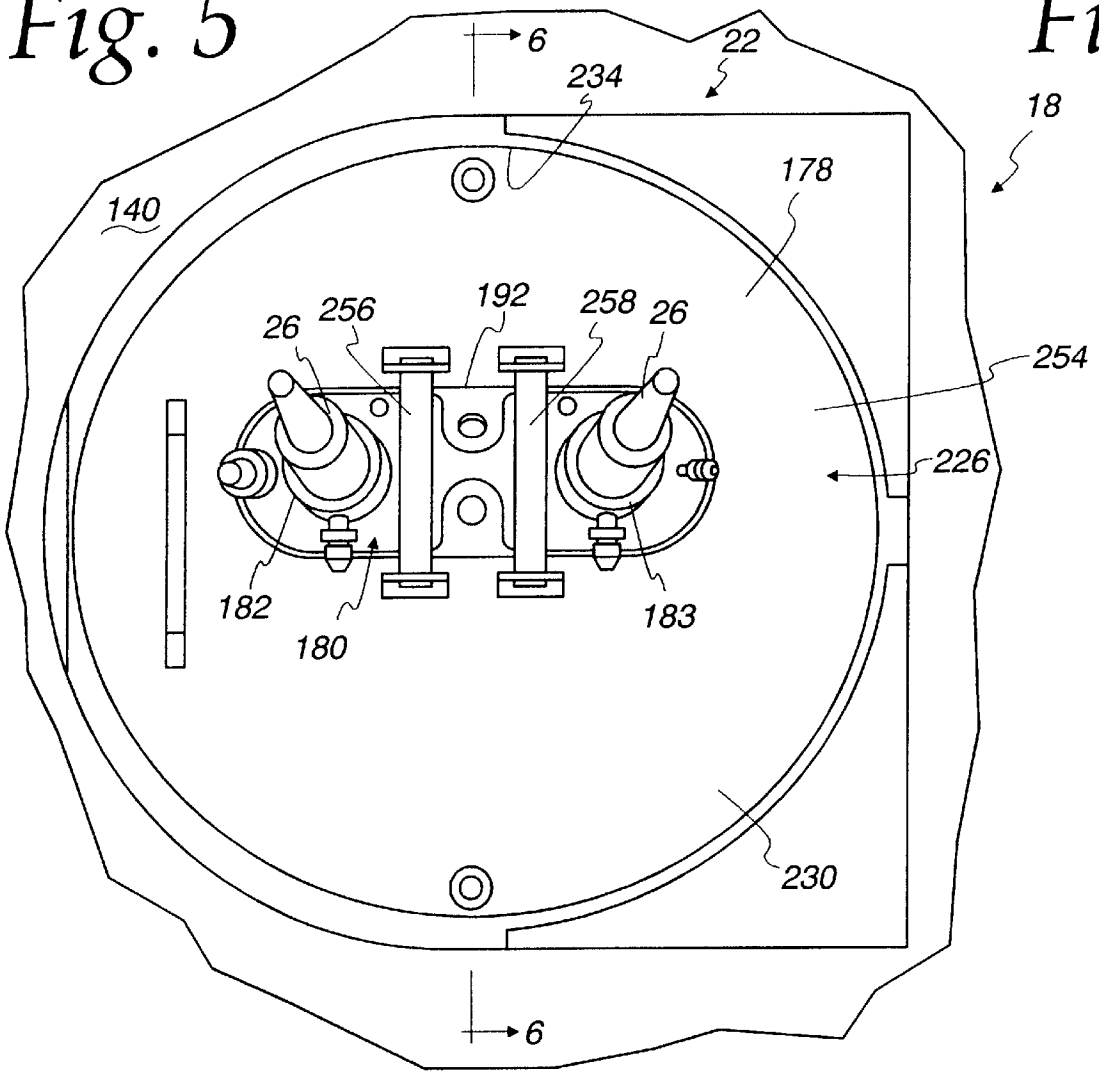
FIG. 5 is an enlarged, elevation view of a torch assembly on the waste disposal device, according to the present invention.
Figure 9:
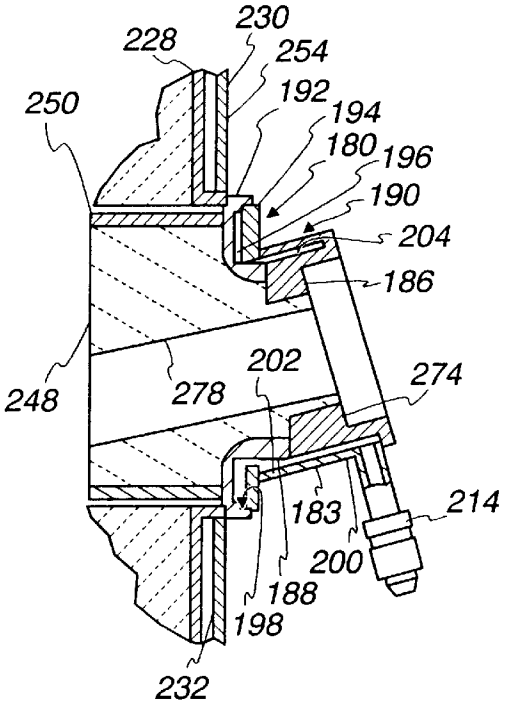
FIG. 9 is a cross-sectional view of the torch holder taken along line 9—9 of FIG. 7.

According to the invention, the torch assembly 22 is removably attached to the wall structure 140 in an opening 176 therethrough. The torch assembly 22, as seen most clearly in FIGS. 1 and 5–9, consists of a base plate 178 and a torch holder 180 that is removably mounted to the base plate 178 in an operative position thereon, as shown in FIGS. 1, 5 and 6. The torch holder 180 has protruding, cylindrical elements 182, 183 having recessed seats 184, 186, respectively, to each accommodate a single torch 26. The torch holder 180 is designed to maintain a pair of torches 26 in a preferred angular relationship to each other and the high temperature melting region 148 within the incineration space 32.

Another aspect of the invention is the provision of a self-contained cooling system in the torch assembly 22. In a preferred form, the base plate 178 and torch holder 180 are made with cooling systems that are both independent of each other and independent of the wall structure 140 on the waste disposal device 18.

More particularly, the cooling structure defines a means for circulating a cooling fluid in heat exchange relationship with each of the base plate 178 and torch holder 180. In the case of the torch holder 180, a flow passage 188 for cooling liquid is defined by a metal frame 190. The metal frame 190 is defined by a plurality of welded metal parts. First and second substantially flat frame parts 192, 194 are nested, one within the other, with a space 196 being maintained therebetween to define a part of the flow passage 188. The frame parts 192, 194 are welded along a seam 198. Exemplary cylindrical element 183 is formed in part by a cylindrical frame part 200 having an inner end 202 that is welded to the frame part 194. An annular space 204 is maintained fully around the cylindrical frame part 200 and communicates with the space 196 to make up a part of the flow passage 188.

A cooling liquid, and preferably water from a supply 206, is pressurized by a pump 208 and delivered through an inlet conduit 210 from the pump 208 to each of three inlet nozzles 212, 214, 216 on the torch holder 180, through the passage 188 in heat exchange relationship with the metal frame 190, and is returned via outlet nozzles 218, 220, 222, and through a return conduit 224 to the water supply 206.

The cooling system on the base plate 178 is also defined by a metal frame 226, including flat parts 228, 230, which form bounding walls for a flow passage 232 therebetween. The wall parts 228, 230 are joined at a seam 234 by welding. An inlet nozzle 236 communicates cooling liquid from the inlet conduit 210 to the passage 232 and to an outlet nozzle 238, which is attached to the return conduit 224.

Each of the frames 190, 226 is embedded in a fire resistant, refractory material. The base plate frame 226 has a refractory body 240 that is complementary in size and shape to the opening 176 through the wall structure 140. A metal band 242 surrounds the refractory body 240 and is welded to the back of the wall part 228. The refractory body 240 has a recessed seat 244 formed therein for accepting the torch holder 180 and an opening 246 for the torches 26 that diverges inwardly. A slight space is shown between the torch holder 180 and seat 244 for clarity. This space is absent in the preferred embodiment.

The torch holder 180 has a refractory body 248 and a surrounding metal band 250 with an oval shape that is matched to the seat 244 in the base plate 178. The metal band 250 is welded to the frame part 192 so that an inwardly facing shoulder 252 is formed around the circumference of the metal band 250. With the torch holder 180 in an operative position on the base plate 178, the shoulder 252 abuts to the outwardly facing surface 254 on the base plate 178. A pair of mounting brackets 256, 258 maintain the torch holder 180 in its operative position on the base plate 178. Through this arrangement, the torch holder 180 is removably maintained in the operative position on the base plate 178.

The base plate 178 is in turn removably maintained in its operative position on the wall structure 140. To assure proper alignment of the base plate 178 on the wall structure 140, projections 260, 262 are formed on the metal frame 226 for reception in complementary recesses 264, 266 in the wall structure 140. A packing material 268 is placed between the projections 260, 262 and the wall structure 140 in the recesses 264, 266.

The base plate 178, with this arrangement, seals the wall structure opening 176. The cooperating projections 260, 262 and recesses 264, 266 assure that the base plate 178 is consistently aligned in the opening 176. The oval torch holder 180 is in turn consistently aligned in its operative position on the base plate 178.

Figure 7:
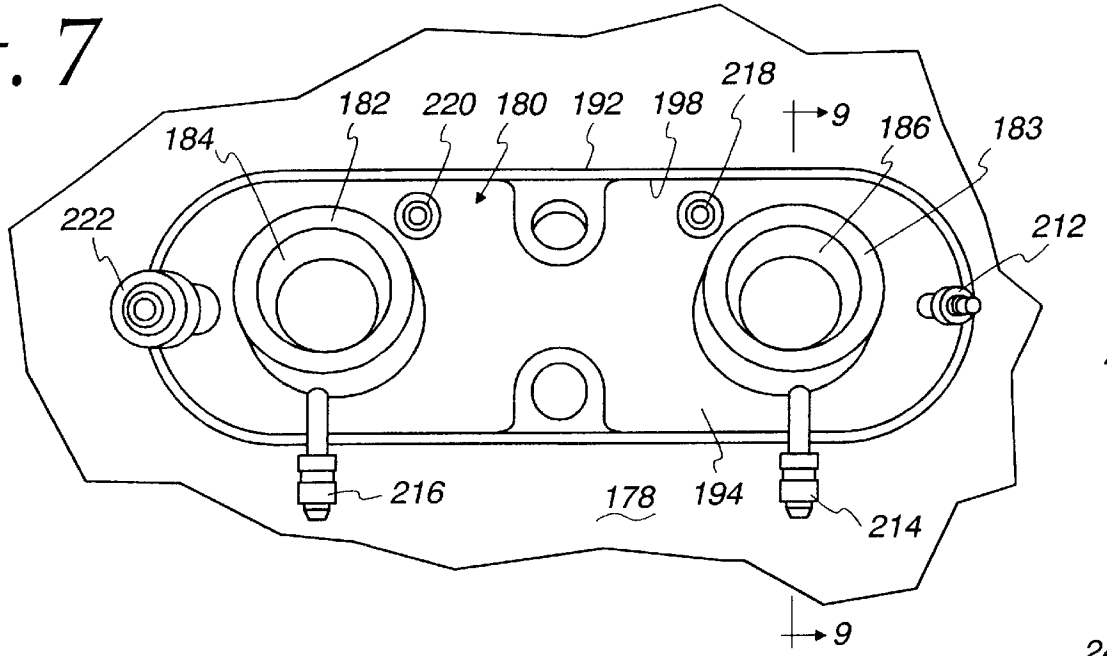
FIG. 7 is an enlarged, elevation view of a torch holder on the torch assembly of FIGS. 5 and 6.
Figure 8:
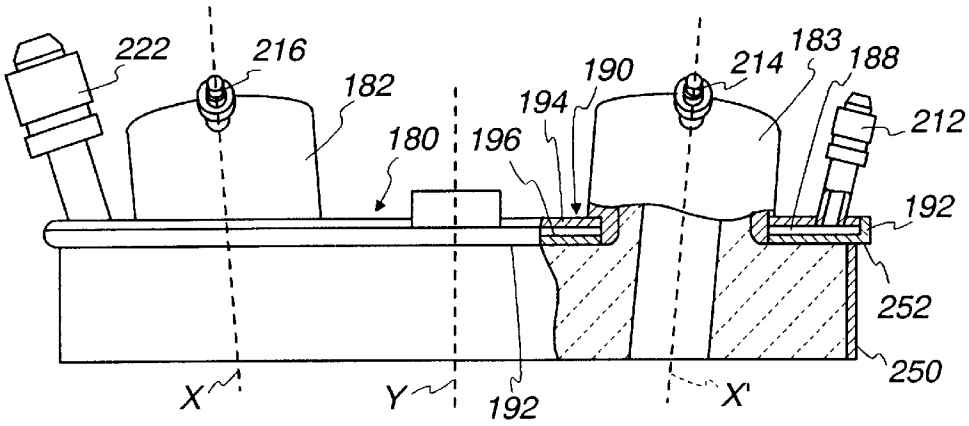
FIG. 8 is an enlarged, bottom view of the torch holder in FIG. 7.
Figure 11:
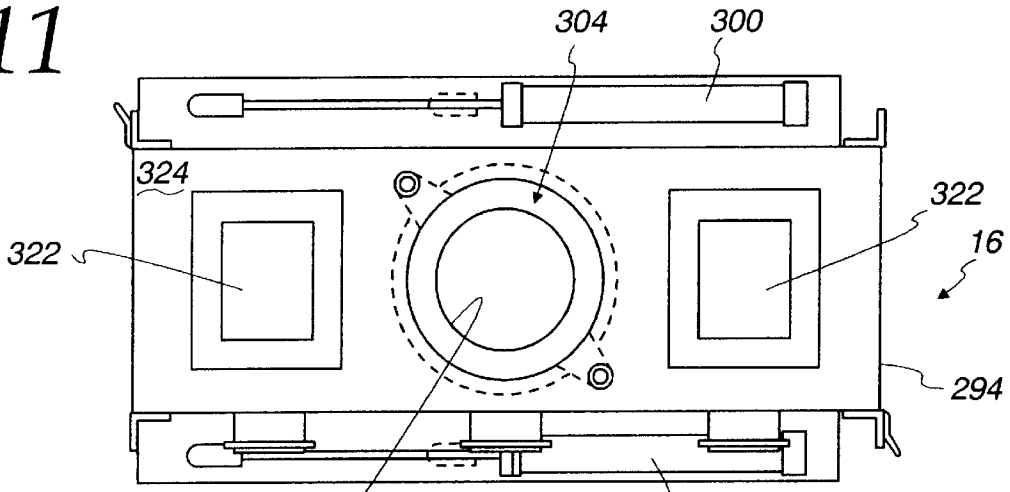
FIG. 11 is a plan view of the molten slag collection unit in FIG. 10.
Figure 10:
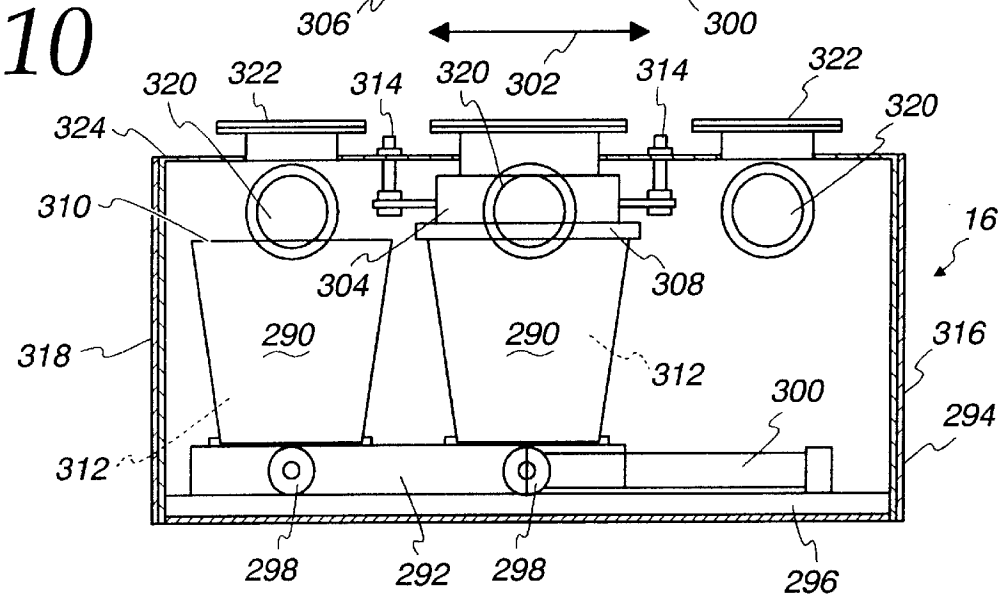
FIG. 10 is an elevation view of a molten slag collection unit on the waste disposal system of FIGS. 1–3.
Figure 12:
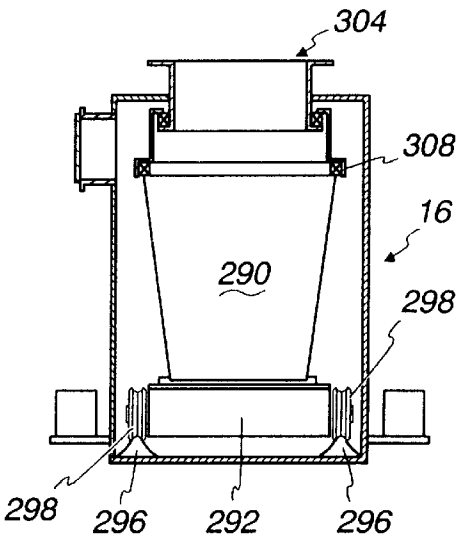
FIG. 12 is a side elevation view of the molten slag collection unit of FIGS. 10 and 11.

The torches 26 are removably placeable in the seats 184, 186 in the cylindrical elements 182, 183. The exemplary seat 186 closely accepts a radially enlarged portion 270 of the torch 26. With a shoulder 272 on the torch portion 270 abutting to the bottom surface 274 of the seat 186, a reduced diameter portion 276 of the torch projects into a through opening 278 in the refractory body 248 and is closely surrounded thereby. As seen in FIG. 7, the central axis X for the cylindrical element 182 is angled to a greater extent than the central axis $X^1$ for the cylindrical element 183 is relative to a plane Y bisecting the torch holder 180. Precise alignment of the torches 26 on the torch holder 180 is assured by this arrangement.

With the above structure, the torch assembly 22 is cooled in close proximity to the areas where the most intense heat is generated by the torches 26. The systems for cooling the torch holder 180 and base plate 178 are independent of each other and of the wall structure 140. Accordingly, if for any reason either of the cooling systems needs to be repaired or replaced, the operator can simply separate the torch holder 180 from the base plate 178 and/or the base plate 178 from the wall structure 140. This obviates the need to have the service person physically enter the incineration space 32 to access the cooling systems. Additionally, the repair person can effect repairs without waiting for the entire system to cool down, as would be required if access to the incineration space would be necessary. In the event of a failure of part or all of either of the cooling systems, either system can be independently repaired.

Further, the systems are designed so that the welds, which are used to join the parts of the metal frames 190, 226, are located either within the thickness of the wall structure 140 or at the exterior thereof. In either event, the welds are not directly exposed to the intense heat in the high temperature melting region 148. As seen, for example, in FIG. 9, the weld between the cylindrical element 183 and the frame part 194 and the weld between the frame parts 192, 194 are located externally of the wall structure 140. The weld between the metal band 250 and the frame part 192 is located in the opening 176, i.e. within the thickness of the wall structure 140, adjacent to the outside thereof. In FIG. 6, the weld at the seam 234 is on the exterior of the wall structure 140, with the weld between the metal band 242 and the frame part 228 residing within the thickness of the wall structure 140, adjacent the outside thereof.

Thus, the likelihood of failure or cracking of welds is minimized by reason of not having direct exposure of these welds to the intense heat within the high temperature melting region 148. In the event of a failure, the metal part is readily accessed by removing the torch assembly 22.

The above arrangement also facilitates precise mounting and removal of the torches 26. In the described arrangement, the torches 26 are removably mountable consistently in the proper orientation with respect to the incineration space 32.

The torches 26 are preferably plasma torches with a space formed between a base anode and tip cathode. The differential between the anode and cathode generates the plasma arc 162 in the high temperature melting region 148. Compressed air is supplied to the region where the arc is developed. While compressed air can be used as the process gas, it is also known to use Ar, $N_2$, $CO_2$, or $H_2$, or a mixture of these gases.

In a preferred form, backup burners are mounted in the incineration space 32 and are aligned to be parallel to the arc 162. With this arrangement, the temperature at the reservoir 154 in the incineration space is on the order of 1500°–1600° C. By changing the angle of the backup burners, the arc from the backup burners may spiral as it interacts with the arc from the torches 26.

The second phase incineration unit 20 incorporates a like torch assembly 22 in a wall structure 282 formed generally in the same manner as the wall structure 140, but on a smaller scale. The wall structure 282 has an input opening 284 to receive exhaust gases from the fitting passage 166 and the conduit 170. An exhaust duct 286 releases the harmless end product after the exhaust gases are combusted in the treatment space 288 within the wall structure 282. All surfaces which are exposed to the high temperature exhaust gas are made of a fire resistant material.

The torch assembly 22 associated with the second phase incineration unit 20 is constructed, mounted, and cooled in the same manner as the torch assembly 22 on the first phase incineration unit.

Preferably, backup burners are also used in the second phase incineration unit 20 to produce a temperature above 850° C. to effectively combust the exhaust gases. The angle of the backup burners can be controlled to produce the previously described spiral effect.

Slag Collection Subsystem 16

The slag collection subsystem 16, shown in FIGS. 1 and 10–12, consists of two, or more, collection buckets 290 mounted on a carriage 292 that is translatable guidingly within a container 294 on a pair of guide rails 296. The carriage 292 has wheels 298 which ride along the top of the rails 296. Air cylinders 300, acting between the container 294 and carriage 292, are extendable and retractable to move the carriage 292 in the line of the double-headed arrow 302. The carriage 292 is dimensioned to accommodate two of the buckets 290, as seen clearly in FIG. 10.

The container 294 has a central lid assembly 304 with a central feed passage 306 defined therethrough. The lid assembly 304 includes a lower rim 308 that can be engaged closely to the upper edge 310 of each bucket 290 so that the feed passage 306 is in communication with the internal storage space 312 defined by each bucket 290. Through rotatable screws 314 or other suitable vertical repositioning mechanism, the lid assembly 304 can be raised and lowered relative to a subjacent bucket 290.

In operation, the container 294 is situated beneath the waste disposal device 18 so that the discharge nozzle 142 aligns vertically directly over the feed passage 306. The lid assembly 304 is lowered through the screws 314 to the operative position shown in FIG. 10. When a predetermined amount of molten slag has accumulated in the active bucket 290, the lid assembly 304 is elevated. The carriage 292 is then shifted to the right in FIG. 10 to situate the empty bucket 290 beneath the lid assembly 304. As this occurs, the filled bucket 290 moves adjacent to a hinged access door 316, which can be opened to remove the filled bucket 290. After the next bucket 290 is filled, the carriage 292 is shifted to the left in FIG. 10 so that the empty bucket 290 is underneath the lid assembly 304 and the filled bucket is situated adjacent to a separate hinged access door 318, which can be opened to empty that bucket 290.

Windows 320 allow viewing of the contents of the buckets 290 in each of three different positions within the container 294. Lights 322 in the top wall 324 of the container 294 illuminate the region over the containers 290 to facilitate viewing of the contents thereof through the windows 320.

Control Subsystem 28

Ignition systems for the plasma torches 26 are shown at 326 in FIG. 1. An electrical power generator 328 supplies the ignition systems 326 and an air compressor 329, which compresses the processing gas for the torches 26. A flow regulator 330 controls the delivery of the processing gas. Through a control panel 332, the operation of the water pump 208 and power generator 328 is controlled.

The air compressor 329 also supplies pressurized air to operate the air cylinders 96, 98 associated with the pusher system 88 (FIG. 3), the air cylinders 300, associated with the slag collection system 16 (FIGS. 10–12), and the cylinder 134 on the waste feed subsystem 12 (FIG. 3). A valve 342 opens and closes an air passage through which the flow regulator 330 delivers gas. All of the air cylinders could be replaced by hydraulic cylinders, in which event an hydraulic pump would be substituted for the air compressor 340. A separate control panel 344 is provided for the waste feed subsystem 12.

Overall Operation

Waste, such as hospital waste that has been contaminated by blood and/or urine, is placed in the containers 30. The containers 30 are placed on the input conveyor 38 and transferred to the elevator section 40, raised to the height of the output conveyor 42, and transferred thereto by operating the motor 76 to rotate the rollers 60. The drive motor 82 is operated to advance the containers 30 along the output conveyor 42 to the point that they are picked up by the plate 92 on the pusher assembly 88. The blocking plate 110 is retracted to allow the containers 30 to advance into the transition chamber 128. The blocking plate 110 is placed in the blocking position and the blocking plate 116 is retracted. The cylinder 134 is operated so that the ram 132 advances the containers 30 into the chamber 136 immediately over the blocking plate 120. The blocking plate 116 is then placed in a blocking position and the blocking plate 120 retracted to allow the containers 30 to pass through the entry opening 102 and into the incineration space 32. The blocking plate 120 is then placed in a blocking position to cover the entry opening 102. The containers 30 accumulate in the high temperature melting region 148. A plasma region is developed by the torches 26 to reconstitute the containers 30 and the waste therein. The efficiency of reconstitution is improved by the provision of backup burners, whereby the treatment temperature reaches 1500°–1600° C. The containers 30 and the contents thereof are thus reconstituted to molten slag.

The exhaust produced by this reconstitution is burned by the plasma arc within the incineration space 32. Any of the exhaust gas that is not completely broken down in the incineration space 32 is delivered to the second phase incineration unit 20 via the conduit 170 and the passage 166. In the second phase incineration unit 20, a plasma region is created through a similar torch assembly 22 and backup burners. Preferably, the temperature resulting from the combined effect of the torches 26 and backup torches reaches 850° C. Through this high temperature combustion, the gases are detoxified, the black soot particles from the smoke are eliminated, and the production of dioxins is controlled. A harmless gas results that can be safely discharged to the atmosphere.

Since toxins such as HCl and SOx are eliminated from the gas ultimately exhausted at the duct 286, an additional treatment step can be performed as need dictates. The treated gas can be cooled to 55° C. through a shower in a coolant tower. Additional particles may be eliminated through the use of a cyclone dryer or scrubber. This step can be skipped depending upon particle contamination. After that, dioxins can be removed through an alkali wash or charcoal filtering. The resulting exhaust gas is virtually harmless to the environment.

As the containers 30 and the contents thereof are reconstituted, slag accumulates in the reservoir 154. Eventually, the slag accumulates to the height of the ledge 152 and spills over into the outlet opening 158 and passes through the passage 160 in the discharge nozzle 142. The discharging, molten slag, continues to be heated through the high temperature exhaust that is drawn through the passageway 166 in the discharge nozzle 142.

The discharging slag is accumulated in the buckets 290, which are monitored and removed as they are filled.

In the event that the torch assemblies 22 are in need of repair or replacement, through a simple command from the control 332, the torches 26 can be turned off and the entire system operation interrupted. The entire torch assembly 22 can then be removed and worked upon without entering the incineration space 32.

It is contemplated that many variations of the above system can be incorporated without departing from the spirit of the invention. For example, a simple hopper system can be substituted for the waste feed subsystem 12, described above. Steps that are carried out automatically in the above system 10 can be carried out fully or partially manually. The number of damper systems 104, 106, 108 described is a matter of design choice. The molten slag can be continuously conveyed away on conveyors. All of the above are examples of contemplated variations.

The foregoing disclosure of specific embodiments is intended to be illustrative of the broad concepts comprehended by the invention.

We claim:

1. A waste disposal device comprising:

a wall structure defining an incineration space;

a torch assembly separate from the wall structure; and first means cooperating between the torch assembly and wall structure for maintaining the torch assembly in an operative position on the wall structure, said torch assembly comprising a base plate, a torch holder, and a torch that is separate from both the base plate and torch holder for generating heat in the incineration space with the torch assembly in the operative position, said torch assembly further comprising second means for circulating a cooling liquid in heat exchange relationship with at least one of the base plate and torch holder independently of the wall structure with the base plate and torch holder in the operative position on the wall structure and the torch fully separated from both the base plate and torch holder.

2. The waste disposal device according to claim 1 wherein the first means comprises means for removably maintaining the torch assembly in the operative position on the wall structure.

3. The waste disposal device according to claim 2 wherein the torch comprises a plasma torch that produces a plasma arc in the incineration space.

4. The waste disposal device according to claim 2 wherein the second means comprises first and second substantially flat parts on the base plate that are spaced from each other to define a passage through which a cooling liquid can be circulated.

5. The waste disposal device according to claim 2 wherein the second means comprises first and second systems for independently circulating a cooling liquid in heat exchange relationship with the torch assembly.

6. The waste disposal device according to claim 2 wherein there is a second torch on the torch assembly for generating heat in the incineration space with the torch assembly in the operative position.

7. The waste disposal device according to claim 2 wherein the second means comprises means for circulating a cooling fluid in an annular path around the torch.

8. The waste disposal device according to claim 2 wherein the means cooperating between the torch holder and base plate comprise means for removably maintaining the torch holder and base plate in the assembled relationship.

9. The waste disposal device according to claim 2 in combination with a supply of cooling liquid circulated by the second means.

10. The waste disposal device according to claim 1 wherein the second means comprises a plurality of frame parts that are joined by a first plurality of welds to define a flow passage for guiding liquid in a circulation path and the plurality of welds are not directly exposed to the incineration space.

11. A waste disposal device comprising:

a wall structure defining an incineration space;

a torch assembly separate from the wall structure; and first means cooperating between the torch assembly and wall structure for maintaining the torch assembly in an operative position on the wall structure, said torch assembly comprising a torch for generating heat in the incineration space with the torch assembly in the operative position, said torch assembly further comprising second means for circulating a cooling liquid in heat exchange relationship with the torch assembly independently of the wall structure to thereby effect cooling of the torch assembly, wherein the first means comprises means for removably maintaining the torch assembly in the operative position on the wall structure, wherein the second means comprises first and second systems for independently circulating a cooling liquid in heat exchange relationship with the torch assembly, wherein the torch assembly comprises a base plate, a torch holder separate from the base plate and means cooperating between the torch holder and base plate for maintaining the torch holder in an operative position on the base plate, and the first system comprises means for circulating a cooling liquid in heat exchange relationship with the torch holder and the second system comprises means for circulating a cooling liquid in heat exchange relationship with the base plate.

12. The waste disposal device according to claim 11 wherein the torch holder includes a cylindrical element against which the torch is seated and the second means comprises means for circulating a cooling liquid in heat exchange relationship with the cylindrical element.

13. The waste disposal device according to claim 12 wherein the torch holder includes a mounting plate and means cooperating between the cylindrical element and mounting plate for maintaining the mounting plate and cylindrical element in assembled relationship and the second means comprises means for circulating a cooling liquid in heat exchange relationship with the mounting plate.

14. A waste disposal device comprising:

a wall structure defining an incineration space;

a torch assembly separate from the wall structure; and first means cooperating between the torch assembly and wall structure for maintaining the torch assembly in an operative position on the wall structure, said torch assembly comprising a torch for generating heat in the incineration space with the torch assembly in the operative position, said torch assembly further comprising second means for circulating a cooling liquid in heat exchange relationship with the torch assembly independently of the wall structure to thereby effect cooling of the torch assembly, wherein the first means comprises means for removably maintaining the torch assembly in the operative position on the wall structure, wherein the wall structure has an opening therethrough in communication with the incineration space, the torch assembly comprises a base plate and with the torch assembly in the operative position the base plate substantially seals the opening in the wall structure.

15. A waste disposal device comprising:

a wall structure defining an incineration space;

a torch assembly separate from the wall structure; and first means cooperating between the torch assembly and wall structure for maintaining the torch assembly in an operative position on the wall structure, said torch assembly comprising a torch for generating heat in the incineration space with the torch assembly in the operative position, said torch assembly further comprising second means for circulating a cooling liquid in heat exchange relationship with the torch assembly independently of the wall structure to thereby effect cooling of the torch assembly, wherein the wall structure has an inside surface and an outside surface and a thickness between the inside and outside wall structure surfaces and the second means comprises a plurality of frame parts that are joined by a plurality of welds to define a flow passage for guiding liquid in a circulation path and the plurality of welds reside at least one of a) between the inside and outside surfaces of the wall structure and b) outside of the wall structure.

16. The waste disposal device according to claim 15 wherein all of the welds joining the frame parts reside at least one of a) between the inside and outside surfaces of the wall structure and b) outside of the wall structure.

17. A torch assembly to be mounted to a wall structure on a waste disposal device, said torch assembly comprising:

a base plate;

a torch holder on the base plate having a seat for a torch;

first means for circulating a cooling liquid in heat exchange relationship with at least one of the base plate and torch holder independently of a wall structure on a waste disposal device and with there being no torch in the torch holder seat; and second means on the torch assembly for cooperating with a wall structure for a waste disposal device for maintaining the torch assembly in an operative position on a wall structure on a waste disposal device.

18. The torch assembly according to claim 17 in combination with a plasma torch that produces a plasma arc and held by the torch holder in the torch seat.

19. The torch assembly according to claim 17 wherein the second means comprises means for removably maintaining the torch assembly in the operative position on a wall structure on a waste disposal device.

20. The waste disposal device according to claim 17 wherein the second means comprises means for removably maintaining the torch assembly in the operative position on the wall structure.

21. A torch assembly to be mounted to a wall structure on a waste disposal device, said torch assembly comprising:

a base plate;

a torch holder on the base plate;

first means for circulating a cooling liquid in heat exchange relationship with at least one of the base plate and torch holder independently of a wall structure on a waste disposal device; and second means on the torch assembly for cooperating with a wall structure for a waste disposal device for maintaining the torch assembly in an operative position on a wall structure on a waste disposal device, wherein the first means comprises first and second systems for independently circulating a cooling liquid in heat exchange relationship with the at least one of the base plate and torch holder.

* * * * *